United States Patent [19]

Levine

[11] 4,064,641

[45] Dec. 27, 1977

[54] FOOTWEAR

[75] Inventor: Beth Levine, New York, N.Y.

[73] Assignee: Betherb, Inc., New York, N.Y.

[21] Appl. No.: 745,123

[22] Filed: Nov. 26, 1976

[51] Int. Cl.[2] ..... A43B 3/00; A41D 1/06

[52] U.S. Cl. ..... 36/1.5; 2/232

[58] Field of Search ..... 36/1.5, 100, 101; 2/232

[56] References Cited

U.S. PATENT DOCUMENTS

| | | | |
|---|---|---|---|
| 1,090,223 | 3/1914 | McNeer | 36/1.5 |
| 2,824,390 | 2/1958 | Walker | 36/1.5 |
| 3,312,982 | 4/1967 | Pitman | 36/1.5 |
| 3,744,158 | 7/1973 | Walker | 36/1.5 |

*Primary Examiner*—Patrick D. Lawson

*Attorney, Agent, or Firm*—Friedman, Goodman & Teitelbaum

[57] ABSTRACT

An article of footwear having a shoe portion including an upper with a mouth, and a tubular portion adapted to be selectively coupled to the shoe portion. A fastener interconnects one end of the tubular portion to the mouth of the upper. A reversible cuff on the tubular portion is available to conceal the connected fastener and a reversible collar on the shoe portion is available to conceal the unconnected fastener and to prevent any abrasive contact with the leg of the wearer. When the shoe portion is used alone there is provided an ankle boot, and when used in combination with the tubular portion there is provided a calf high boot.

9 Claims, 4 Drawing Figures

FOOTWEAR

BACKGROUND OF THE INVENTION

This invention relates to footwear, and more particularly to selectively connectable portions of footwear to form multiple size and style boots.

There are numerous shoe constuctions which include detachable sections for facilitating their use on a wearer's foot, as well as for adjusting for various sizes and styles of the shoe. For example, U.S. Pat. No. 2,302,596 describes a shoe which contains a sole to which various uppers can be connected. The uppers are divided into sections which permit their interconnection and the completed upper can then be connected to the sole portion. The upper typically includes a divided rear portion which can be fastened together.

Another type of shoe construction is described in U.S. Pat. No. 2,235,490 which again includes a fixed sole portion and an upper containing a slit along the side thereof by which a fastener can connect the two portions of the upper. Furthermore, a fastener such as a zipper is provided to detach the complete upper from the sole portion. Also, U.S. Pat. No. 2,236,367 additionally provides a shoe construction which includes a first part having a sole and heel with interconnecting straps, in the form of a sandal, and an upper attachable to the sandal portion.

In each of these constructions, the upper is selectively detachable from the sole to facilitate entry of a foot into the shoe, or to vary the size of the upper while maintaining the sole of a predetermined fixed size. While these patents refer to shoes, there are unique special problems in connection with boot construction.

Typically, boots come in various heights. Occasionally, there is provided an ankle high boot which includes a shoe construction having an upper with an extended top portion rising up to the ankle. Other types of boots continue even higher than the ankle and include a tubular portion extending up to and generally including the calf of the leg. Occasionally, the tubular calf portion will be split to facilitate entry of the leg into the boot. However, the height of the boot is generally fixed once the boots are purchased. Of course, it is possible in some cases to fold over the top of the boot and thereby lower the height of the boot, but this becomes difficult, and frequently impossible, when the boot material is of heavy construction or of stiff material.

Accordingly, when a user pruchases a pair of boots, the height of the boot is fixed and must be maintained once purchased.

Boots further present an additional problem which is not faced in shoe construction. With shoes, the desire is to provide a proper sized upper. To do that, generally the only concern is the length and width of the foot itself. With boots, especially calf high boots, there is an additional size dimension which must be considered. Specifically, the girth of the calf of the leg. Many individuals may have a small foot size, but heavy calf portions. Therefore, although a specific boot size may be prescribed for that individual, the boots will be most uncomfortable because the calf portion of the boot will not comfortably fit around the calf of the leg. To accommodate such varying calf thicknesses, it is frequently necessary to place a slit in the tubular portion of the boot, or use straps, or other means to permit varying of the tubular circumference of the boot. However, this detracts from the beauty and elegance of the boot style and also makes it difficult to put on the boots since they must always be properly adjusted by means of the snaps, ties, or other straps providing the size adjustment for the calf thickness.

SUMMARY OF THE INVENTION

Accordingly, it is an object of the present invention to provide an article of footwear which avoids the aforementioned problems of prior art devices.

A further object of the present invention is to provide footwear, typically a boot, which permits adjustment of the boot height, and particularly selection between an ankle high boot and a calf high boot.

Yet a further object of the present invention is to provide an article of footwear which permits selective interchanging of various calf portions onto a lower shoe portion, thereby permitting selective choice of size to accommodate proper shoe size and proper calf thickness.

Yet another object of the present invention is to provide an article of footwear containing a shoe portion and a selectively attachable tubular portion, and including appropriate concealing means to avoid detection of the interconnection between the two portions.

A further object of the present invention is to provide an article of footwear which contains an ankle high boot to which can be selectively connected a tubular extension providing a low or high boot.

Briefly, there is provided an article of footwear including, in combination, a shoe portion comprising an upper and a tubular portion which is adapted to be selectively coupled to the shoe portion. A mouth is located in the upper for accommodating entry of a foot therein. The tubular portion comprises a first and second open end. The first open end is available for receiving a foot therein prior to its entry into the mouth of the upper. A fastening means is provided for selectively coupling the second open end with the mouth. Concealing means are included for concealing the fastening means when the shoe and tubular portion are coupled together. The shoe portion can thereby be used along as a low boot, or in combination with the tubular portion as a high boot.

The concealing means includes a reversible cuff located proximate the second open end. The reversible cuff has a first upwardly extending position exposing the fastening means, and a second downwardly extending position covering the fastening means.

There can be further included a reversible collar positioned proximate the mouth of the upper. The collar also has a first inwardly folded position placing it against the inner walls of the upper, and a second outwardly turned position overhanging the mouth of the upper.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings like reference characters designate like parts.

DESCRIPTION OF THE PREFERRED EMBODIMENT

Figure 1:
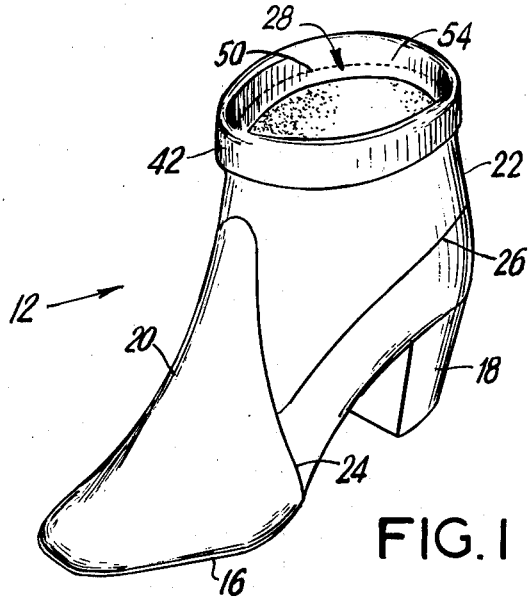
FIG. 1 shows a perspective view of the shoe portion of the footwear.

Referring now to the drawings, there is shown an article of footwear, specifically shown as a shoe boot 10 including a shoe portion 12 formed on the lower part of the footwear and a tubular portion 14 on the upper part thereof. The shoe portion includes a sole 16, a heel 18 and an upper 20. An upward extension 22 extends to reach the ankle portion. Various designs 24 and 26 are formed on the upper to provide style. They can also include stitching or welts to interconnect sections of the upper in the usual shoe construction. A mouth 28 is formed at the top part of the upper 20 which can receive a foot as it is entered into the shoe portion.

The tubular portion 14 is formed as a cylinder and has a first end on the top thereof 30, which can receive the foot prior to its entry into the mouth 28 of the shoe portion 12. A second end 32 is provided at the lower part of the tubular portion and is of a size which can mate with the mouth of the upper.

A fastening means, shown by way of example as a zipper, is available for interconnecting the second end 32 of the tubular portion 14 with the mouth 28 of the shoe portion. A first part 34 of the zipper is positioned on the tubular portion and a mating part 36 is positioned on the mouth, to permit their interconnection.

Figure 2:
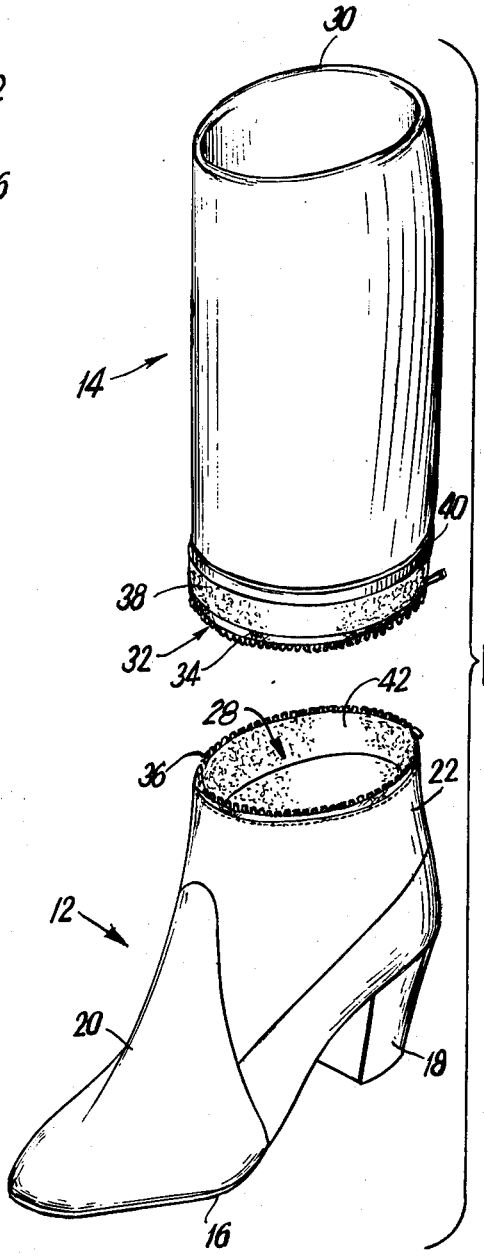
FIG. 2 is an exploded view of the two parts of the footwear including the shoe portion and the tubular portion.
Figure 3:
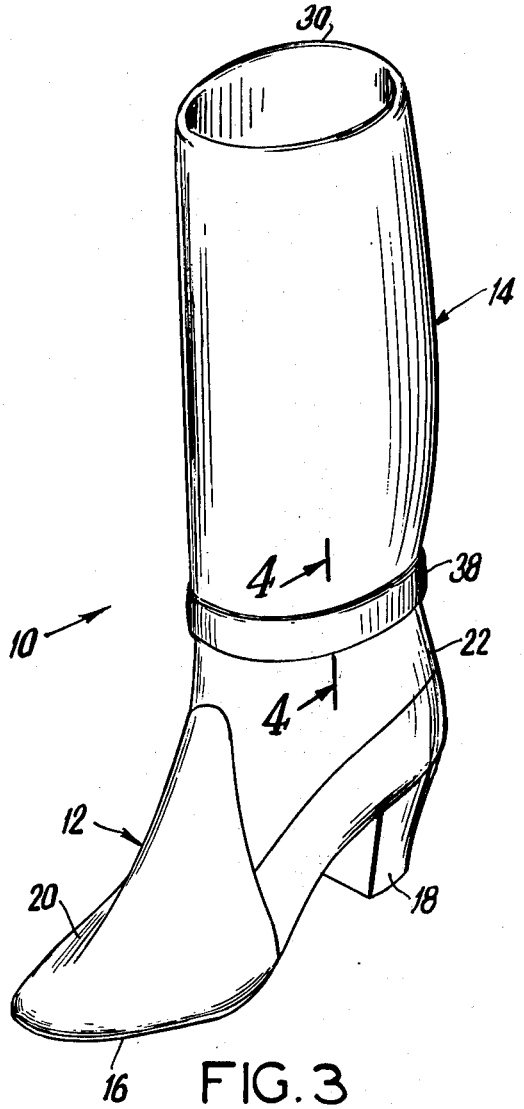
FIG. 3 is a perspective view of the interconnected tubular portion and shoe portion.

A cuff 38 is formed proximate the second end 32 at the bottom of the tubular portion 14. The cuff can be folded into a first and second position. In its first position, it is upwardly folded (as shown in FIG. 2) to expose the zipper portion 34. In its second position, it extends downwardly (as shown in FIG. 3) to cover the zipper. The reversible cuff includes a hem portion 40 which is formed facing the inner surface of the cuff material.

The mouth of the shoe portion is provided with a collar 42 also having a first and second position. In its first position, it is inwardly folded (as shown in FIG. 2), wherein it lies flat against the inner wall of the upper material to expose the portion 36 of the zipper. In its second position, it is outwardly turned to overhang the mouth of the upper (as shown in FIG. 1).

Figure 4:
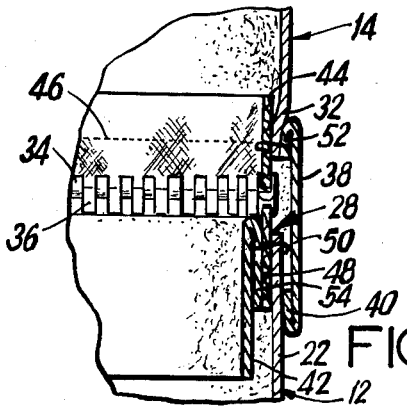
FIG. 4 is a fragmentary sectional view taken along line 4—4 of FIG. 3.

Referring to FIG. 4, the interconnections of the various sections of the fastening means together with the cuff and collar are described. The cuff 38 is shown in its second, downwardly extended position and is shown connected to the outer surface of the tubular portion proximate the second end 32. The zipper portion 34 connected onto the zipper tape 44 is fastened to the inner surface of the tubular member 14 also proximate the second end 32. The stitching line 46 can be utilized to simultaneously connect the tape 44 and the cuff 38. It will be noted that the hem 40 turns inwardly of the cuff.

The zipper portion 36 is connected by means of the zipper tape 48 to the inner surface of the shoe portion 22 proximate the mouth 28 thereof. The collar 42 is connected to the inner side of the tape 48. The line of stitching 50 can simultaneously interconnect both the shoe portion 22 and the collar 42 to the tape 48.

In order to facilitate the proper reversing of the cuff 38, there is provided an inwardly turned lip portion 52 which is utilized for connection to the tubular portion of the boot. Similarly there is provided an inwardly turned lip 54 on the collar connected to the inside of the shoe portion.

In use, the shoe portion 12 can be used by itself to provide an ankle high boot. In order to conceal the zipper portion 36, the collar is outwardly folded, as shown in FIG. 1, to fold over and cover the zipper part. When it is desired to interconnect the tubular portion and provide a high boot, the collar is inwardly folded so that it lies flat against the inner wall of the shoe portion, as shown in FIG. 2. It will be noted that no hem is formed on the collar in order to eliminate any bumps or protrusions when the collar is folded inwardly to thereby permit easy insertion of the foot into the shoe. The cuff on the tubular portion is shown upwardly turned to expose the zipper portion on the second end of the tubular portion. The tubular portion can then be coupled to the shoe portion by pulling the zipper completely around the circumference of the tubular portion. The cuff is then folded downward, as shown in FIG. 3, to cover the closed zipper and conceal the fact that there are actually two interconnected portions. The foot can then be inserted into the first end 30 of the calf portion and pushed down into the shoe.

It will therefore be appreciated that with the footwear described, there can be selectively provided a low boot as an ankle boot or a high boot as a calf boot. Furthermore, the height of the tubular portion can be extended higher to include a knee high boot, or even higher boots, as is desired. Further more, various tubular portions can be interchanged with a single shoe portion. In this manner, it is possible to provide different style tubular portions which can be selectively connected to a shoe portion. As a result, different collars can be mixed and matched between the tubular portions and the shoe portions. Additionally, different size tubular portions can be utilized with various shoe portions. In using this footwear, an individual can be measured firstly for a proper shoe size, and then the girth of the calf measured and an appropriate tubular portion selected. The size of the tubular portion can be varied and need not be cylindrical as is shown. It can be formed in a truncated shape to provide for wider calf sizes, also other shapes can be utilized, as is desired. Similarly, slits or openings can be formed in the tubular porton to accommodate insertion of the foot into the shoe boot.

By means of the cuff and collar, it is possible to completely conceal the fastening means. When used as a low boot, the collar is folded to conceal that portion of the zipper located at the mouth of the shoe portion. When used as a high boot, the cuff is utilized to fold over and extend downwardly concealing the closed zipper and to prevent any abrasive contact with the leg of the wearer.

The cuff and collar provide a concealing arrangement and at the same time provide for a style and design for the shoe boot.

Although a zipper has been shown for the fastening means, it will be appreciated that other types of fastening means can be utilized, such as snaps, Velcro fasteners, hooks, and the like. Also, although the mouth and matching second end are shown circular in shape, it will be appreciated that other shapes could be utilized as long as the two are provided with fastening means which can interconnect and couple them together.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. In an article of footwear, the combination of a shoe portion comprising an upper, a mouth in said upper for accommodating entry of a foot therein, a tubular portion detachably coupled to said shoe portion, said tubular portion having first and second open ends, said first open end for receiving a foot therein prior to its entry into said mouth, fastening means for selectively coupling said second open end with said mouth, means for concealing said fastening means when said shoe and tubular portions are coupled together, said concealing means including a reversible cuff proximate said second open end, said reversible cuff having a first upwardly folded position exposing said fastening means and a second downwardly extended position covering said fastening means, said concealing means further including a reversible collar proximate said mouth of said upper, said collar having a first inwardly folded position wherein said collar is positioned against an inner wall of said upper, and an outwardly turned position overhanging said mouth of said upper, whereby said shoe portion can be used alone as a low boot and also can be used in combination with said tubular portion as a high boot.

2. An article of footwear as in claim 1 and further comprising a hem formed at an extended edge of said cuff.

3. An article of footwear as in claim 1 and wherein said fastening means includes a first portion thereof located at said second open end, and a second portion thereof at said mouth, said second portion mating with said first portion to couple the shoe portion with the tubular portion, and wherein said collar in its inwardly folded position exposes said second fastening portion, and in its outwardly turned position, covers said second fastening portion.

4. An article of footwear as in claim 1 and wherein said fastening means includes a zipper.

5. An article of footwear as in claim 3 and further comprising attaching means for connecting said first fastening portion at an inner surface of said second end, for connecting said cuff to an outer surface of said second end, for connecting said second fastening portion to an inner surface of said mouth, and for connecting said collar to an inner surface of said second fastening portion.

6. An article of footwear as in claim 5 and wherein said cuff includes a lip portion turned toward said tubular portion for attachment to said tubular portion, and wherein said collar includes a lip portion turned toward said second fastening portion for attachment thereto.

7. An article of footwear as in claim 5 and wherein said attaching means includes a line of stitching.

8. An article of footwear as in claim 1 and wherein said upper includes an upwardly extending ankle portion, and said tubular portion extends to a calf height, whereby said shoe portion is an ankle high boot and in combination with said tubular portion provides a calf high boot.

9. An article of footwear as in claim 1 and wherein said mouth and said second end are substantially similar, and are circular in shape.

* * * * *